US009123225B2

(12) United States Patent
Breed et al.

(10) Patent No.: US 9,123,225 B2
(45) Date of Patent: Sep. 1, 2015

(54) ROBUST ALARM SYSTEM WITH AUXILIARY PROCESSING SUB-SYSTEM

(75) Inventors: Jason A. Breed, Richmond Hill (CA); Stephane Foisy, Udora (CA); Gregory W. Hill, Newmarket (CA)

(73) Assignee: TYCO SAFETY PRODUCTS CANADA LTD., Concord (CA)

( * ) Notice: Subject to any disclaimer, the term of this patent is extended or adjusted under 35 U.S.C. 154(b) by 279 days.

(21) Appl. No.: 13/593,012

(22) Filed: Aug. 23, 2012

(65) Prior Publication Data

US 2013/0201015 A1 Aug. 8, 2013

Related U.S. Application Data

(60) Provisional application No. 61/595,457, filed on Feb. 6, 2012.

(51) Int. Cl.

| | |
|---|---|
| ***G08B 23/00*** | (2006.01) |
| ***G08B 29/02*** | (2006.01) |
| ***G08B 29/18*** | (2006.01) |

(52) U.S. Cl.

CPC ..... *G08B 29/02* (2013.01); *G08B 29/18* (2013.01)

(58) Field of Classification Search

CPC ..... G08B 23/00; G08B 29/02; G08B 29/18; G08B 29/16

USPC ..... 340/501, 521; 725/108

See application file for complete search history.

(56) References Cited

U.S. PATENT DOCUMENTS

| | | | | |
|---|---|---|---|---|
| 8,166,498 | B2 * | 4/2012 | Walter | 725/12 |
| 8,413,204 | B2 * | 4/2013 | White et al. | 725/133 |
| 8,605,218 | B2 * | 12/2013 | Jiang et al. | 348/563 |
| 8,612,591 | B2 * | 12/2013 | Dawes et al. | 709/225 |
| 8,754,763 | B2 * | 6/2014 | Morehead | 340/501 |
| 8,819,178 | B2 * | 8/2014 | Baum et al. | 709/218 |
| 2004/0250108 | A1 * | 12/2004 | Parsons et al. | 713/200 |
| 2005/0216302 | A1 * | 9/2005 | Raji et al. | 705/1 |
| 2005/0222820 | A1 * | 10/2005 | Chung | 702/188 |
| 2006/0294565 | A1 | 12/2006 | Walter | |
| 2007/0226616 | A1 * | 9/2007 | Gagvani et al. | 715/700 |
| 2012/0154138 | A1 * | 6/2012 | Cohn et al. | 340/501 |
| 2012/0331109 | A1 * | 12/2012 | Baum et al. | 709/219 |

OTHER PUBLICATIONS

International Search Report and Written Opinion mailed Apr. 30, 2013, in related PCT Application No. PCT/CA2013/000047.

* cited by examiner

*Primary Examiner* — Eric M Blount

(57) ABSTRACT

An alarm system includes two subsystems: a security subsystem that performs critical alarm condition monitoring and reporting; and an auxiliary subsystem that allows execution of other non-critical software components. The security subsystem may monitor the performance of the auxiliary subsystem, and maintain the performance by resetting and/or otherwise controlling the execution of software and use of hardware at the auxiliary subsystem, providing increased overall reliability of the security system, without compromising its ability to monitor security conditions at an associated premises.

21 Claims, 5 Drawing Sheets

ROBUST ALARM SYSTEM WITH AUXILIARY PROCESSING SUB-SYSTEM

CROSS-REFERENCE TO RELATED APPLICATIONS

The present application claims benefits from U.S. Provisional Patent Application No. 61/595,457 filed Feb. 6, 2012, the contents of which are incorporated herein by reference.

FIELD OF THE INVENTION

The present invention relates generally to alarm systems, and more particularly to alarm systems that may be feature rich, yet robust in operation.

BACKGROUND OF THE INVENTION

It is common for businesses and homeowners to have a security system for detecting alarm conditions at their premises and reporting these to a monitoring station. One of the primary functions of the monitoring station is to notify a human operator when one or more alarm conditions have been sensed by detectors installed at a monitored premise.

Detectors may vary from relatively simple hard-wired detectors, such as door or window contacts to more sophisticated battery operated ones, such as motion and glass break detectors. The detectors may all report to an alarm control module at the premises. The control module is typically installed in a safe location and is connected to a power supply. The control module is further in communication with the individual detectors to communicate with or receive signals from the detectors. The communication between the alarm control module and the detectors can be one or two way, and may be wired or wireless.

Current day consumers, however, expect in-premises equipment to have sophisticated graphical user interface and provide non-critical functions. As such, there is a desire to have an alarm system function provide such a feature-rich graphical user interface to allow for the control of the alarm system. Additionally, it is desirable to allow the alarm system to provide further functionality such as multi-media playback, video monitoring and the like. Existing dedicated alarm systems are highly robust having been thoroughly tested. They provide alarm monitoring capabilities 24 hours a day, 7 days a week for many years at a time. Introducing the increased functionality risks the availability of the core alarm system functions.

Accordingly, there is a need for improved alarm systems that may be feature-rich, but may also provide the robust monitoring expected of such systems.

SUMMARY OF THE INVENTION

Exemplary of embodiments, an alarm system includes two subsystems: one (referred to as a security subsystem) that performs critical alarm condition monitoring and reporting; another (referred to as an auxiliary subsystem) that allows execution of other non-critical software components. The security subsystem may monitor the performance of the auxiliary subsystem, and maintain the performance by resetting and/or otherwise controlling the execution of software and use of hardware at the auxiliary subsystem, providing increased overall reliability of the alarm system, without compromising its ability to monitor security conditions at an associated premises.

In an example embodiment, an alarm system control panel comprising: a security subsystem, comprising a microcontroller, configured to communicate with a plurality of sensors for sensing alarm conditions at the premises; at least one network interface in communication with the microcontroller; an auxiliary subsystem, comprising a microprocessor, in communication with memory, the memory hosting an operating system, and at least one application; a communication link interconnecting the first subsystem to the second subsystem providing a communication path allowing the first subsystem and the second subsystem to exchange monitoring and reset messages; memory storing instructions for execution at the security subsystem and the auxiliary subsystem, to allow the first subsystem to monitor the performance of the second subsystem, and to selectively reset at least portions of the auxiliary subsystem, to maintain the operation of the auxiliary subsystem.

In another example embodiment, a method of operating an alarm system comprising first and second subsystems, includes: executing software to monitor alarm conditions at the premises using the first subsystem; executing software to provide at least one user application at the second subsystem; executing management software at both the first and second subsystems to allow the first subsystem to monitor computing performance of the second subsystem, and to selectively reset at least portions of the second subsystem to maintain satisfactory operation of the second subsystem.

In another example embodiment, an alarm system includes a security processing subsystem, in communication with a plurality of sensors for sensing alarm conditions at the premises; at least one network interface; and an auxiliary processing subsystem, executing an operating system and at least one lifestyle application for use at the premises, independent of the security processing subsystem. The security subsystem is operable to sense and report alarm conditions at the premises and monitor operation of the auxiliary subsystem.

In another example embodiment, an alarm system comprising: a first subsystem, comprising a processor, in communication with a plurality of sensors for sensing alarm conditions at the premises; at least one network interface in communication with the processor of the first subsystem, for reporting sensed alarm conditions to a monitoring center; a second subsystem, comprising a processor, in communication with memory, the memory hosting an operating system and at least one application; wherein the first subsystem is operable to sense and report alarm conditions at the premises and wherein lifestyle applications for use at the premises are executed on the second subsystem; a communication link interconnecting the first subsystem to the second subsystem providing a communication path allowing the first subsystem and the second subsystem to exchange monitoring and reset messages; memory storing instructions for execution at the first and second subsystem, to allow the first subsystem to monitor the performance of the second subsystem, and to selectively reset at least portions of the second subsystem, to maintain the operation of the second subsystem.

Other aspects and features of the will become apparent to those of ordinary skill in the art upon review of the following description of specific embodiments in conjunction with the accompanying figures.

BRIEF DESCRIPTION OF THE DRAWINGS

In the figures which illustrate by way of example only, embodiments of the present invention.

DETAILED DESCRIPTION

Figure 1:
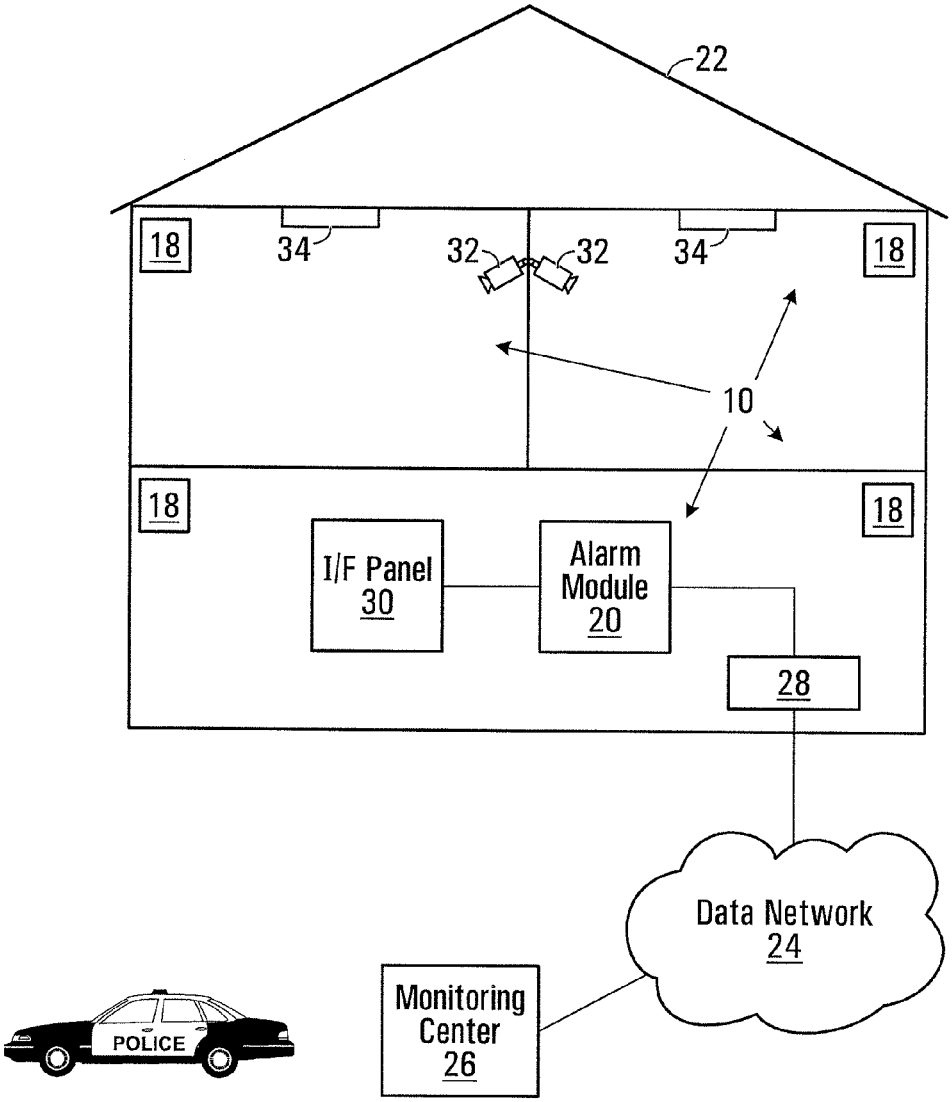
FIG. 1 is a schematic diagram of a premises including an alarm system, exemplary of an embodiment of the present invention.

FIG. 1 depicts an exemplary alarm system 10 including an alarm system control module 20 at a customer premises 22 communicating through a data network 24 such as the Internet, with a central monitoring center 26. Data network 24 may be any combination of wired and wireless links capable of carrying packet switched traffic, and may span multiple carriers, and a wide geography. In one embodiment, data network 24 may simply be the public Internet. A combination of DSL adaptor and router 28 may interconnect control module 20 to data network 24.

At residential or business premises 22, control module 20 may be interconnected with one or more detectors 18. Each of detectors 18 provides information regarding the status of the monitored premises to control module 20 at premises 22. Detectors 18 may include, for example, motion detectors, glass break detectors, noxious gas sensors, microphones and contact switches. Detectors 18 may be hard wired to control module 20 or may communicate with control module 20 wirelessly, in manners known to persons of ordinary skill in the art.

Alarm system 10 may optionally further include cameras 32, audio speakers 34, all in communication with control module 20. Optionally, alarm system 10 may include X10, Zigbee wireless, Z-wave wireless, and other home automation/control modules, know to those of ordinary skill, also in communication with control module 20.

As will become apparent, alarm system 10 includes a security component—responsible for monitoring critical security conditions at premises 22, and a further life-style component that provides additional features to residents at premises 22.

Figure 2:
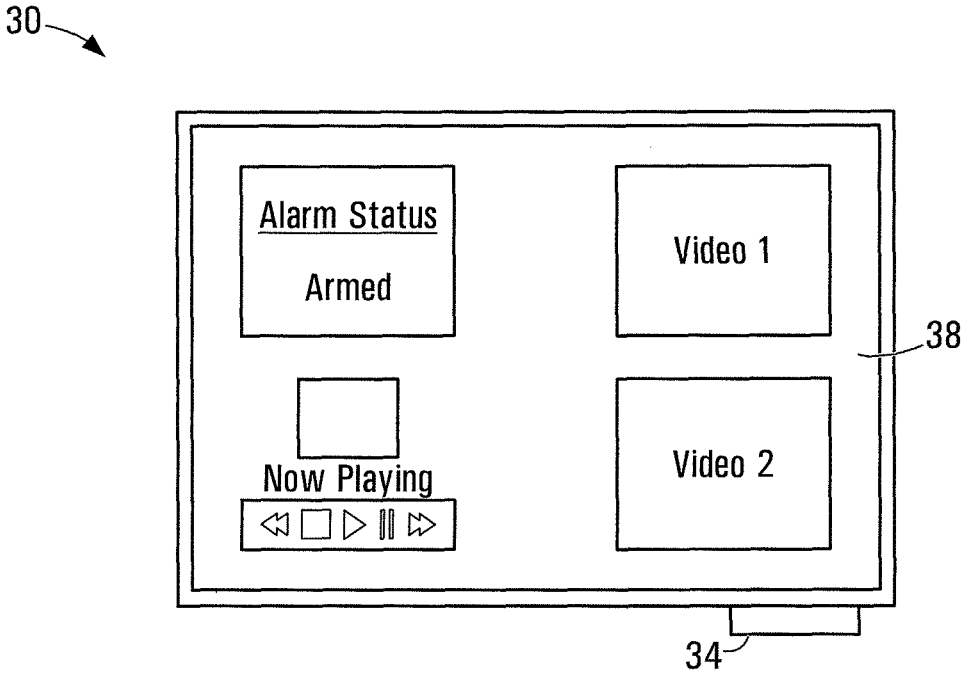
FIG. 2 is a schematic diagram of a control module of the alarm system of FIG. 1.

Conveniently, an interface to alarm system 10 may be provided through a graphical user interface (GUI), presented on a display panel 30, by way of an liquid crystal display (LCD) display; LED display; or similar flat panel display panel 30. Panel 30 is more particularly illustrated in FIG. 2, and may have a resolution of 100×200 or greater pixels. In an embodiment, panel 30 may have a resolution of 720×480 pixels. Panel 30 may further include a touch sensitive interface 38—such as a capacitive touch screen, or a resistive touch screen, used to solicit user input. In an embodiment, panel 30 may be directly electronically interconnected to control module 20. Additionally, panel 30 may include a speaker 34 for presentation of audio at panel 30, as well as a microphone and camera (not specifically illustrated).

Alarm system 10 may further include other interfaces such as key pads, sirens, and the like, not specifically shown in FIG. 1.

Figure 3:
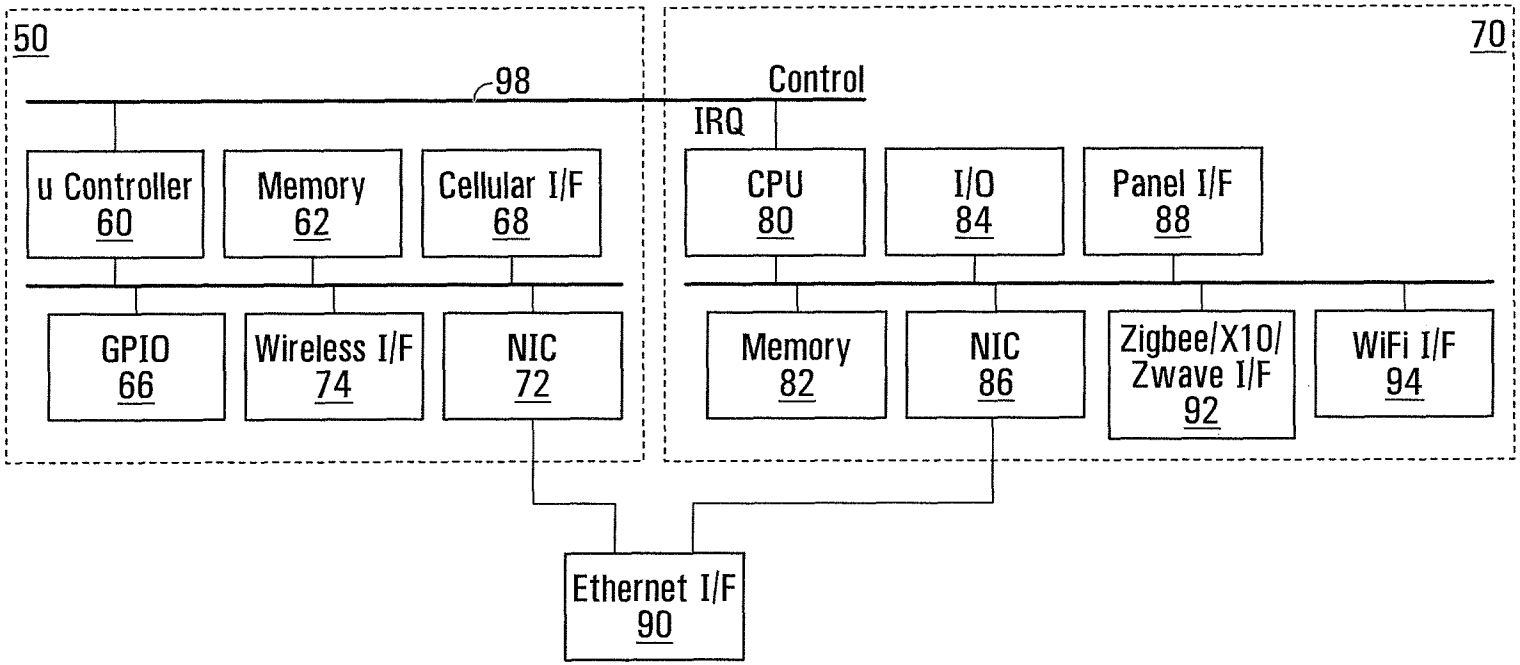
FIG. 3 is a schematic block diagram of an alarm system control module of the alarm system of FIG. 1.

In order to isolate security monitoring abilities from other features, control module 20 includes two processing subsystems as illustrated in FIG. 3: security processing subsystem 50 and auxiliary processing subsystem 70. As will become apparent, security processing subsystem 50 may be characterized as a robust subsystem, responsible for core security monitoring functions of alarm system 10. Auxiliary processing subsystem 70, on the other hand, may be characterized as less robust, providing an auxiliary processing core, hosting a more full featured operating system for providing user applications (e.g. lifestyle applications), and driving a feature rich GUI, that may for example, be presented on panel 30.

To this end, security processing subsystem 50 includes a microcontroller 60; memory 62 in communication with microcontroller 60; one or more general purpose input output interfaces 66 for communication with detectors 18; a data network interface 72 for communication with data network 24; and a cellular network interface 68 allowing security processing subsystem 50 to communicate with a cellular telephone network. Security processing subsystem 50 further includes a wireless interface 74.

Cellular network interface 68 may include a cellular network radio, for transmission of data to a proximate cellular base station. Cellular network interface 68 may for example be a GSM/CDMA/3G/4G/LTE or similar cellular radio, capable of transmitting/receiving GPRX 1×EVO or other data.

In an embodiment, microcontroller 60 includes a built-in processor and peripherals such as memory, I/O, timers, perhaps even serial I/O and ND and D/A functions. Conveniently, all these functions included in a single chip reduce risk of individual component failure and increases robustness. Further, security processing subsystem 50 performs only limited functions, namely security and supervision of the auxiliary processing subsystem 70, thus minimizing the probability and impact of software bugs. Auxiliary processing subsystem 70, on the other hand, may be executing a general purpose operation system—such as Linux, Android, Windows Embedded Compact, or the like, and may rely on off-chip memory and other peripherals, while executing several functions such as lifestyle and user applications, all of which are lower priority than the security features. As such, failure of auxiliary processing subsystem 70—as a consequence of a hardware or software failure—would not be considered catastrophic.

Further, security processing subsystem 50 may be primarily controlled by firmware completely stored in on-chip ROM (or alterable ROM such as EPROM or EEPROM).

Data network interface 72 may be a standard data network interface, like an Ethernet 10/100/1000 Base-T interface network interface card (NIC), allowing security processing subsystem 50 to communicate over a standard Ethernet network.

Wireless interface 74 includes a radio receiver, to allow for wireless communication with detectors 18, and optionally with a key fob, or panel, as further described below.

A bus acts as a memory/peripheral bus to interconnect microcontroller 60 with the described components of security processing subsystem 50.

Memory 62 may be a suitable combination of random access memory and non-volatile memory (e.g. ROM, EPROM, NVRAM, or the like), and may host a suitable firmware and operating software that controls operation of microcontroller 60, and may be organized as a file system or otherwise.

Program instructions stored in memory 62 of security processing subsystem 50, along with configuration data may control operation of alarm detection and reporting by alarm system 10. In particular, one or more data network addresses may be stored in memory 62. These network addresses may include the IP network addresses by which monitoring station 26 may be reached. When alarm system 10 is active, the program instructions cause microcontroller 60 to monitor the state of detectors 18. If a detector 18 is tripped, security processing subsystem 50 of control module 20 under control of microcontroller 60 may send data associated with sensed alarm conditions sensed at premises 22 to central monitoring station 26 over data network 24.

Program instructions stored in memory 62 of control module 20 may further store software components allowing network communications and establishment of connections across data network 24, and optionally connections over a cellular network, using cellular network interface 68. The software components may, for example include an internet protocol (IP) stack. Other software components suitable for establishing a connection and communicating across data network 24 will be apparent to those of ordinary skill.

Conveniently, security processing subsystem 50 provides sufficient alarm functionality to operate, on its own, as a security system. The operating system (if any) of security processing subsystem 50, as well as software executing on security processing subsystem 50 is typically particularly well suited for an alarm system. They may, for example, be particularly "robust" and/or stable, allowing security processing subsystem 50 to function without restart for prolonged periods of time. Robustness and stability in this context, may result from the operating system's and software's lack of bugs, memory leaks, and the like, their ability to handle faults, and ultimately their ability to allow security processing subsystem 50 to remain running without requiring restart.

Auxiliary processing subsystem 70 includes a further microprocessor 80, independent of microcontroller 60, and may act as an auxiliary processing core for alarm system 10 to provide life-style functions, such as for example multimedia functionality, as well as a graphical user interface for alarm system 10. Microprocessor 80 is in communication with processor readable memory 82 that controls operation of microprocessor 80. Microprocessor 80 is in communication with panel 30, to present the GUI discussed above.

Auxiliary processing subsystem 70 may further include input/output interface 84 that allows for the interconnection of peripherals. Input/output interface 84 may, for example, include a USB interface/hub allowing the interconnection of USB peripherals. Auxiliary processing subsystem 70 may further include a general purpose input/output (GPIO) interface (not shown), as well as panel interface 88, for physically interconnecting panel 30 (FIGS. 1 and 2) to auxiliary processing subsystem 70.

A network interface (NIC) 86 allows auxiliary processing subsystem 70 to communicate over a data network. NIC 86 may be a standard data network interface, such as an Ethernet 10/100/1000 Base-T interface.

Panel interface 88 may include a display interface for presenting images on a display, such as the display of panel 30, allowing processor 80 to control operation of panel 30, and sense user interaction with panel 30/touch screen 38.

One or more additional communications interfaces 92, 94 may allow subsystem 70 to independently communicate with home automation interfaces at premises 22, directly or over wireless network. Communications interfaces 92, 94 may, for example, be a combination of one or more wireless interfaces—such as mesh network interfaces (e.g. Zigbee or Zwave interfaces); IEEE 802.1 WiFi interfaces; or similar wireless communications interfaces, to allow for communication with home automation interfaces at premises 22.

Speakers 34 (FIG. 1) may be interconnected to auxiliary processing subsystem 70 through input/output interface 84, or through a separate amplifier (not shown) forming part of, or in communication with auxiliary processing subsystem 70. A bus acts as a memory/peripheral bus to interconnect processor 80 with the described components of auxiliary processing subsystem 70.

Network interface 90 may be a standard Ethernet switch/router, in communication with MC 72 and NIC 86 of subsystems 50 and 70, to allow subsystems 50, 70 to share a network connection to data network 24, by way of a standard (e.g. Ethernet) router 28 (shown in FIG. 1). Router 28 may in turn be interconnected to data network 24 by a DSL modem, cable model, optical interface or the like. Router 28 may also include a wireless WiFi interface, providing wireless IEEE 802.11 access to data network 24, and thus acting as a WiFi access point.

Security processing subsystem 50 and auxiliary processing subsystem 70 may be in communication with each other by way of bus 98, and/or additional control lines. Bus 98 may, for example be a control and communications bus may, as for example, a parallel bus; a universal serial bus; and I2C bus, or any other suitable bus and control lines for exchanging control and status messages between security processing subsystems 50 and auxiliary processing subsystem 70, as described herein. Bus 98 may include data lines to allow the two-way passage of data between microcontroller 60 and processor 80. Additionally, bus 98 may allow for the passage of control commands, and may for example include reset lines, or interrupt lines to allow the hardware reset of processor 80 by microcontroller 60, as described below.

Subsystems 50 and 70 may be formed on a single printed circuit board, housed in a common housing, or on separate printed circuit boards. Other components of alarm system 10, such as a keyboard, speaker, power supply, may also form part of control module 20, but are not depicted.

In an embodiment, microprocessor 80 may be a reduced instruction set computing (RISC) processor, such as ARM based processor, running a multi-tasking operating system, and preferably a real-time operating system (RTOS).

Figure 4:
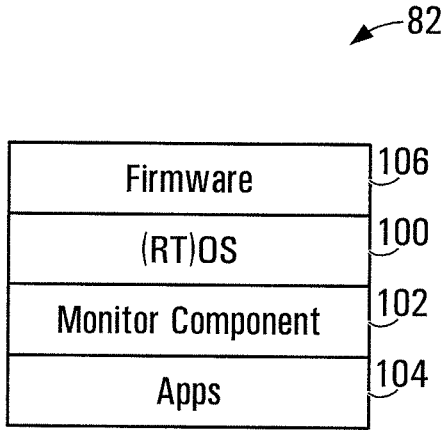
FIG. 4 is block diagram illustrating the organization of memory at a subsystem of the alarm system of FIG. 1.

Exemplary organization of memory 82 is depicted in FIG. 4. As illustrated, memory 82 stores firmware 106, an operating system 100, a monitoring component 102, and applications 104, for execution by processor 80. As noted, operating system 100 may be a UNIX based operating system, such as for example, a LINUX or BSD derivative, like the Android™ operating system, or other suitable operating system.

Applications 104 may be used by processor 80 to provide desired end-user functionality. For example, memory 82 may store a video viewing application for viewing video from a variety of cameras 32 (FIG. 1) at premises 22. Memory 82 may further store a video telephony, multimedia music/video application; and the like. For example, alarm system 10 may optionally be able to stream video or audio content from data network 24 for presentation at panel 30, or through speakers 34. Video, audio and other similar content may be stored at a remote server (not shown) that provides lifestyle content. Applications 104 may also be downloaded over data network 24. In the event operating system 100 is Android™ based, suitable applications may be made available through the Android™ store, or other repository.

Further, operating system 100 may include, or be in communication with monitoring component 102. Monitoring component 102 may be an application, or a kernel loadable module. Monitoring component 102 may provide monitoring functionality for auxiliary processing subsystem 70, and may further allow for communication of subsystem 70 with security processing subsystem 50, to allow security processing subsystem 50 to monitor the operational health of auxiliary processing subsystem 70. Firmware 106 may include a boot loader, required by processor 80 to allow loading of operating system 100 and other low-level firmware.

Conveniently, a back-up copy of firmware 106 may also be stored within memory 82, and used in the maintenance of system 10 as described below.

Central monitoring station 26 of FIG. 1 is depicted as a single monitoring station; however, it could alternatively be formed of multiple monitoring stations, each at a different physical location, and each in communication with data network 24. In particular, in order to process a high volume of alarm conditions from a large number of subscribers, central monitoring station 26 includes one or more monitoring server (s). The monitoring server processes alarm messages from alarm system, like alarm system 10 of a plurality of subscribers serviced by central monitoring station 26. Optionally, the monitoring server may take part in two-way audio communication over data network 24, with an interconnected alarm system 10.

The monitoring server may include a processor, network interface and memory and may physically take the form of a rack mounted card. The monitoring server may be in communication with one or more operator terminals. An example monitoring server may comprise a SUR-GARD™ SG-System III Virtual Receiver, available from DSC.

The monitoring server of central monitoring station 26 may be associated with an IP address and port(s) by which it can be contacted by alarm system 10 to report alarm events over data network 24, and establish other IP connections. An operator at the terminal may further be able to establish outgoing telephone calls, to the police or third party security personnel. To that end, the terminal may be proximate a PSTN telephone, or may include or have access to voice-over-IP software allowing call establishment.

Monitoring station 26 may further include, or have access to, a subscriber database that includes a database under control of a database engine. The database may contain entries corresponding to the various subscribers serviced by monitoring station 26. The database may, for example, include the names and addresses, phone number, contact phone number, for each subscriber as well as a unique identifier of each control module 20 assigned to a particular subscriber; account information; and the like.

Monitoring station 26 receives and processes incoming messages from control module 20. Extracted data from the incoming messages may, for example, be overhead, or alarm data. The alarm data may be used to make decisions under software control at monitoring station 26 based upon that data. In particular, monitoring station 26 may be programmed to initiate certain alarm handling procedures based on the received data.

For example, alarm data extracted from one or more incoming alarm messages may specify that a particular detector 18 at a particular monitored premises 22 was tripped. In response a human operator at a terminal at monitoring station 26 may be notified of the alarm condition using the alarm data, for further action. Further action may include the human operator consulting, and calling, one of a list of phone numbers associated with that particular monitored premise, stored in the database. Database may, for example, include the telephone number(s) of the homeowner and occupants, and the operator may call the homeowner to determine what the problem was/is.

In normal operation, control module 20 is interconnected, at the premises. A user at the premises may arm and disarm the alarm system 10 using panel 30. In particular, an application executing on processor 80 may present the graphical user interface, and solicit input from the touch sensitive screen 38. Processor 80, in turn may react by sending appropriate signals/messages to microcontroller 60 over bus 98 to arm or disarm alarm system 10. The messages/signals may take any conventional form. For example, communication may take place through the exchange of datagrams, or simply by asserting particular lines of bus 98. As well, processor 80 may update panel 30 to reflect the change in status. Arm/disarm commands may be sent from auxiliary processing subsystem 70 to security processing subsystem 50 over bus 98, or directly from panel 30 to security processing subsystem 50. Microcontroller 60, in turn may execute software stored in memory 62 to monitor detectors 18, and respond to a tripped detector 18 by dispatching an alarm message to monitoring station 26, as described above.

Further, additional applications 104 executing on processor 80 may provide users with further functionality—including for example, the ability to stream music or video over data network 24, play stored music, stored on a disk drive or the like, interconnected with control module 20, by way of router 28 or otherwise, display video from cameras 32, or the like. Cameras 32 may provide video data to auxiliary processing subsystem 70, over a local WiFi network, by way of router 28.

Further applications may announce stock prices, the weather, current events, news and the like for display at panel 30 with audio optionally presented at panel 30 or at speakers 34.

As will be appreciated, operating system 100 and applications 104 may include program flaws or bugs, and may thus occasionally cause auxiliary processing subsystem 70 to function in an unexpected or aberrant manner, or to not function at all. This is particularly so, if new applications are downloaded and installed at auxiliary processing subsystem 70. For this reason, subsystems 50 and 70 are generally isolated from each other, with each of subsystems 50 and 70 each having its own memory 62 and 82 and bus. Likewise, security processing subsystem 50 operates under control of microcontroller 60, while subsystem 70 operates under control of processor 80. Conveniently, the architecture of security processing subsystem 50 may mimic the architecture of conventional security system architectures, and may include a robust/stable operating system and software as described above.

As noted, communication between subsystems may be accomplished by bus 98, which may be used by security processing subsystem 50 to ensure operation of auxiliary processing subsystem 70.

Figure 5:
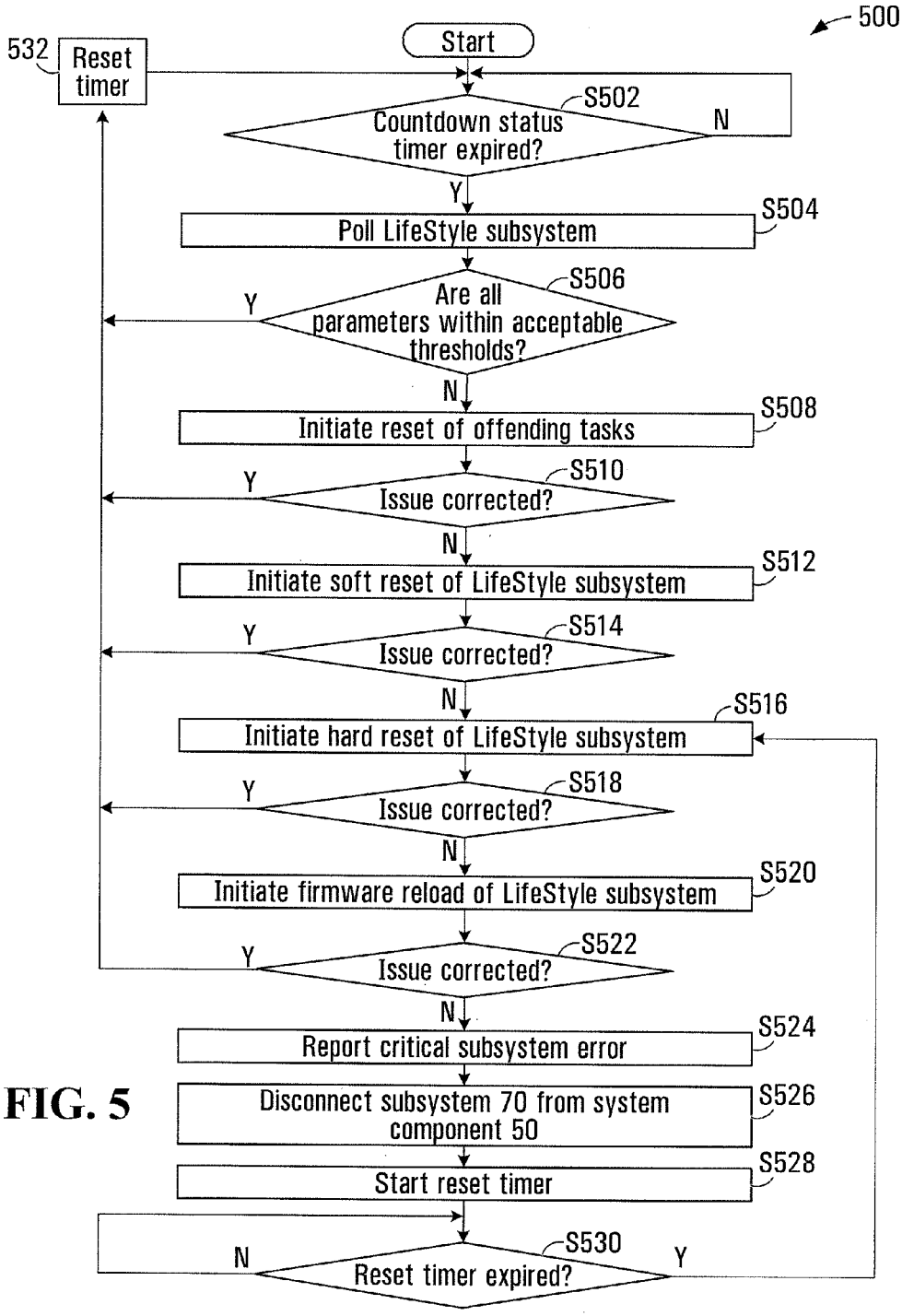
FIG. 5 is a flow chart of steps performed by a processing subsystem of FIG. 3.

To this end, software in memory 62 may periodically monitor the operating parameters of auxiliary processing subsystem 70. Steps performed by software in memory 62 may perform steps S500 depicted in FIG. 5. Specifically, microcontroller 60 under software control periodically sends a status inquiry message to processor 80. This may be done by generating a query message, and dispatching the message to auxiliary processing subsystem 70, over bus 98. In particular, such a message may be sent at the expiry of a countdown timer maintained by microcontroller 60, in block S504. Expiry of the timer may be monitored in block S502. The timer may be a software timer, or a hardware timer maintained by microcontroller 60.

The status message may be processed/responded to by monitoring component 102 of auxiliary processing subsystem 70. Processor 80 may generate one or more status messages, in reply. The status message may include one or more of firmware information (e.g. firmware version); a metric indicating CPU usage of processor 80; memory usage; an identifier of task executing on auxiliary processing subsystem 70 (e.g. by task ID, or otherwise); uptme; Ethernet usage (in % of available bandwidth); WiFi signal strength; Zigbee status; Zwave status; and communication status (e.g. ping time/bandwidth, etc.) to the remote server that provides lifestyle content and/or applications.

Additionally, microcontroller 60 may optionally poll other components of alarm system 10 to ensure that auxiliary processing subsystem 70 is not interfering with the overall operation of alarm system 10. For example, microcontroller 60 may query the operation of network interface 90, to ensure that auxiliary processing subsystem 70 is not using undue bandwidth over data network 24.

In block S504, microcontroller 60 awaits a reply in the form of a suitable message from processor 80, conveying operating parameters of auxiliary subsystem 70—such as any one or more of a metric indicating CPU usage of processor 80; memory usage; an identifier of task executing on auxiliary processing subsystem 70 (e.g. by task ID, or otherwise); uptme; Ethernet usage (in % of available bandwidth); WiFi signal strength; Zigbee status; Zwave status; and communication status (e.g. ping time/bandwidth, etc.), etc. If the message is received and indicates that auxiliary processing subsystem 70 is functioning properly, as determined in block S506, the count-down timer may be reset in block S532, and monitoring by microcontroller 60 may cease until the timer next expires.

If the message received in block S504 indicates that auxiliary processing subsystem 70 is not functioning correctly, as determined in S506, one or more reset messages may be dispatched in block S508 to initiate one or more reset actions on auxiliary processing subsystem 70. The reset messages may kill task; reset wireless interfaces; or the like. The exact nature and type of reset action and corresponding reset message may be determined based on status information received in block S506. For example, if CPU % is above a threshold, the reset message may kill one or more tasks; if the WiFi signal is low, the reset message may cause auxiliary processing subsystem 70 to restart the physical and logical WiFi adapter, by, for example, restarting the adapter, and/or any driver associated with it. Likewise, if auxiliary processing subsystem 70 is using an undue amount of network bandwidth available through network interface 90, tasks using interface 90 on auxiliary processing subsystem 70 may be killed.

In block S510, microcontroller 60 may again assess if auxiliary processing subsystem 70 is functioning correctly, after the corrective action taken in block S508. Again, this may be accomplished by microcontroller 60 by further dispatching a status request message and comparing returned status information to permissible thresholds.

Again, if the resulting message reveals that auxiliary processing subsystem 70 is still not functioning as desired, as determined in block S510, microcontroller may dispatch a command to reset the entire auxiliary processing subsystem 70, in block S512 (a so-called "soft" reset). The reset command may cause processor 80, under control of monitoring component 102, to initiate a shutdown sequence, followed by a start-up sequence. In block S514, microcontroller 60 may once again assess if auxiliary processing subsystem 70 is functioning correctly, after the reset initiated in block S512. Again, this may be accomplished by microcontroller 60 by further dispatching a status request message and comparing returned status information to permissible thresholds.

If the "soft" reset initiated in block S512 is still not successful, microcontroller 60 may initiate a hard-reset in block S516. A hard reset may be initiated by, for example, toggling a reset line of processor 80; disconnecting power from auxiliary processing subsystem 70; or otherwise.

In block S518, microcontroller 60 may again assess if the auxiliary processing subsystem 70 is functioning correctly, after the reset initiated in block S516. Again, this may be accomplished by microcontroller 60 by further dispatching a status request message and comparing returned status information (if any) to permissible thresholds.

If reset initiated in block S516 is still not successful, microcontroller 60 may initiate a firmware re-load at auxiliary processing subsystem 70. Firmware reload may be performed by processor 80, using a backup copy of firmware, stored in memory 82 or in another memory (not shown). Alternatively, firmware may be transferred by microcontroller 60 of security processing subsystem 50 from memory 62 over bus 98 to memory 82 of auxiliary processing subsystem 70 using, for example, an existing bootloader that is part of the resident firmware.

In block S522, microcontroller 60 may again assess if auxiliary processing subsystem 70 is functioning correctly, after the firmware reload initiated in block S520. Again, this may be accomplished by microcontroller 60 by further dispatching a status request message and comparing returned status information (if any) to permissible thresholds.

If auxiliary processing subsystem 70 is still not functioning correctly, security processing subsystem 50 may signal and dispatch a critical a message locally at control module 20 or panel 30, and/or to central monitoring station 26 signalling the failed auxiliary processing subsystem 70. Optionally, auxiliary processing subsystem 70 may be physically disconnected from security processing subsystem 50 in block S526. Periodically an attempt may be made to reset auxiliary processing subsystem 70, by repeating blocks S516 and onward, after expiry of a reset timer in block S528, as determined in block 5530. If the subsystem was disconnected in block S526, and later successfully restored, auxiliary processing subsystem 70 may be reconnected to security processing subsystem 50 after a successful reset/firmware reload.

Optionally, microcontroller 60 may log messages returned in blocks S504, S510, S514, S518, or S522, to allow an installer to debug auxiliary processing subsystem 70. After logging a pre-defined number of messages including failure or instability of auxiliary processing subsystem 70, microcontroller 60 may optionally signal problems with security processing subsystem 50 to monitoring center 26.

As will now be appreciated, blocks S500 describes management software in memory 62, to allow security processing subsystem 50 to monitor the performance of second auxiliary processing subsystem 70, and to selectively reset at least portions of the second auxiliary processing subsystem 70, to maintain the operation of auxiliary processing subsystem 70. Monitoring component 102 provides complementary management software at auxiliary processing subsystem 70. The management software allows security processing subsystem 50 to effectively increase the overall reliability/up-time of the life style component of alarm system 10, without compromising the robust nature of security processing subsystem 50, and thus the security features of alarm system 10.

In the described embodiment, panel 30 has been described as being interconnected with auxiliary processing subsystem 70. In alternate embodiments, panel 30 may be otherwise in communication with auxiliary processing subsystem 70, wirelessly, for example over WiFi through router 28, which may act as an access point. Panel 30 may take the form of a tablet, having its own processor and wireless network interface. It may, for example, be an Apple iPad, or Android table running a suitable application. In further alternate embodiments, panel 30 may be in communication with both subsystems 50 and 70. In order to do so, panel 30 may include a further wireless interface to communicate with wireless interface 74 of security processing subsystem 50 and/or wireless interface 94 of subsystem 70. The wireless interface of panel 30 may generate wireless commands understood by interface 74 as arm/disarm commands. In response security processing subsystem 50 may generate a message indicating the state change to auxiliary processing subsystem 70, over bus 98. Auxiliary processing subsystem 70, in turn may update the display of panel 30 to reflect the change of state of alarm system 10. In yet other embodiments, panel 30 may include several push buttons, each of which generates a signal or message provided to security processing subsystem 50 to arm/disarm alarm system 10. In this way failure of panel 30 may still allow interaction with alarm system 10, through the hard-wired push buttons.

Of course, the above described embodiments are intended to be illustrative only and in no way limiting. The described embodiments of carrying out the invention are susceptible to many modifications of form, arrangement of parts, details and order of operation. The invention, rather, is intended to encompass all such modification within its scope, as defined by the claims.

What is claimed is:

1. An alarm system control panel comprising:

a security subsystem, comprising a microcontroller, configured to communicate with a plurality of sensors for sensing alarm conditions at a premises;

at least one network interface in communication with said microcontroller;

an auxiliary subsystem, comprising a processor, in communication with memory, said memory hosting an operating system, and at least one application;

a communication link interconnecting said security subsystem to said auxiliary subsystem providing a communication path allowing said security subsystem and said auxiliary subsystem to exchange monitoring and reset messages;

memory storing instructions for execution at said security subsystem and said auxiliary subsystem, to allow said security subsystem to monitor performance of said auxiliary subsystem, and to selectively reset at least portions of said auxiliary subsystem, to maintain the operation of said auxiliary subsystem;

wherein said security subsystem is further operable to monitor functionality of said processor, and responds to messages provided by said microcontroller by way of said communication link.

2. The alarm system of claim 1, further comprising a display panel presenting a graphical user interface, controlled by said auxiliary subsystem.

3. The alarm system of claim 1, wherein said at least one network interface is further in communication with said processor.

4. The alarm system of claim 2, wherein said display panel is touch sensitive.

5. The alarm system of claim 1, wherein said security subsystem further comprises memory for hosting software controlling operation of said microcontroller.

6. The alarm system of claim 1, wherein said communication link comprises a bus.

7. The alarm system of claim 6, wherein said processor passes commands to arm or disarm said alarm system over said bus to said microcontroller.

8. The alarm system of claim 6, wherein said bus further comprises a reset line to said processor that may be asserted by said microcontroller.

9. The alarm system of claim 1, wherein said microcontroller is under firmware control.

10. The alarm system of claim 1, wherein said operating system comprises a UNIX based operating system, or a UNIX derived operating system.

11. The alarm system of claim 10, wherein said operating system is the Android operating system.

12. The alarm system of claim 10, wherein said instructions comprise a kernel loadable module at said auxiliary subsystem.

13. A method of operating an alarm system at a premises, said alarm system comprising first and second subsystems, wherein said first subsystem comprises a microcontroller, and said second subsystem comprises a microprocessor, said method comprises:

executing software to monitor alarm conditions at said premises using said first subsystem;

executing software to provide at least one user application at said second subsystem;

executing management software at both said first and second subsystems to allow said first subsystem to monitor computing performance of said second subsystem, and to selectively reset at least portions of said second subsystem to maintain satisfactory operation of said second subsystem;

wherein said management software performs at least one of the following:

(a) a soft reset of said second subsystem, in response to sensing performance problems at said second subsystem;

(b) a hard reset of said second subsystem, in response to sensing performance problems at said second subsystem;

(c) a firmware load of firmware at said second subsystem, in response to sensing performance problems at said second subsystem; and (d) a hard reset of said second subsystem, in response to sensing performance problems at said second subsystem and after having performed a soft reset of said second subsystem that failed to cure performance problems at said second subsystem.

14. The method of claim 13, further comprising executing a UNIX based operating system, or a UNIX derived operating system at said second subsystem.

15. The method of claim 13, wherein said management software causes reset of offending tasks at said second subsystem.

16. The method of claim 13, wherein said management software performs said firmware load of firmware at said second subsystem, after having performed a hard reset of said second subsystem.

17. An alarm system comprising:

a first subsystem, comprising a processor, in communication with a plurality of sensors for sensing alarm conditions at a premises;

at least one network interface in communication with said processor of said first subsystem, for reporting sensed alarm conditions to a monitoring center;

a second subsystem, comprising a processor, in communication with memory, said memory hosting an operating system and at least one application;

wherein said first subsystem is operable to sense and report alarm conditions at said premises and wherein lifestyle applications for use at said premises are executed on said second subsystem;

a communication link interconnecting said first subsystem to said second subsystem providing a communication path allowing said first subsystem and said second subsystem to exchange monitoring and reset messages;

memory storing instructions for execution at said first and second subsystem, to allow said first subsystem to monitor performance of said second subsystem, and to selectively reset at least portions of said second subsystem, to maintain the operation of said second subsystem;

wherein said first subsystem is operable to perform at least one of the following:

(a) reset offending tasks at said second subsystem;

(b) perform a soft reset of said second subsystem, in response to sensing performance problems at said second subsystem;

(c) perform a hard reset of said second subsystem, in response to sensing performance problems at said second subsystem;

(d) perform a firmware load of firmware at said auxiliary subsystem, in response to sensing performance problems at said second subsystem; and (e) in response to sensing performance problems at said second subsystem, perform a hard reset of said second subsystem, after having performed a soft reset of said second subsystem that failed to cure performance problems at said second subsystem.

18. An alarm system comprising:

a security processing subsystem, in communication with a plurality of sensors for sensing alarm conditions at a premises;

at least one network interface;

an auxiliary processing subsystem, executing an operating system and at least one lifestyle application for use at said premises, independent of said security processing subsystem;

wherein said security processing subsystem is operable to sense and report alarm conditions at said premises and monitor operation of the auxiliary subsystem;

wherein said security processing subsystem is operable to perform at least one of the following:

(a) reset offending tasks at said auxiliary processing subsystem;

(b) perform a soft reset of said auxiliary subsystem, in response to sensing performance problems at said auxiliary subsystem;

(c) perform a hard reset of said auxiliary processing subsystem, in response to sensing performance problems at said auxiliary subsystem;

(d) perform a firmware load of firmware at said auxiliary subsystem, in response to sensing performance problems at said auxiliary subsystem; and (e) in response to sensing performance problems at said auxiliary subsystem, perform a hard reset of said auxiliary subsystem, after having performed a soft reset of said auxiliary subsystem that failed to cure performance problems at said auxiliary subsystem.

19. The alarm system of claim 18, wherein said security processing subsystem is further operable to selectively reset at least portions of said auxiliary processing subsystem, to maintain the operation of said auxiliary processing subsystem.

20. The alarm system of claim 18, wherein said security subsystem is operable to perform said firmware load of firmware at said auxiliary subsystem, after having performed a hard reset of said auxiliary subsystem.

21. An alarm system control panel comprising:

a security subsystem, comprising a microcontroller, configured to communicate with a plurality of sensors for sensing alarm conditions at a premises;

at least one network interface in communication with said microcontroller;

an auxiliary subsystem, comprising a processor, in communication with memory, said memory hosting an operating system, and at least one application;

a communication link interconnecting said security subsystem to said auxiliary subsystem providing a communication path allowing said security subsystem and said auxiliary subsystem to exchange monitoring and reset messages;

memory storing instructions for execution at said security subsystem and said auxiliary subsystem, to allow said security subsystem to monitor performance of said auxiliary subsystem, and to selectively reset at least portions of said auxiliary subsystem, to maintain the operation of said auxiliary subsystem;

wherein said security subsystem is further operable to perform hard and soft resets of said auxiliary subsystem, and wherein said instructions cause a hard reset of said auxiliary subsystem to cure persistent performance problems at said auxiliary subsystem that a soft reset of said auxiliary subsystem failed to cure.

* * * * *